US009186569B2

(12) United States Patent
Wuerthner

(10) Patent No.: US 9,186,569 B2
(45) Date of Patent: Nov. 17, 2015

(54) SPORTS DEVICE WITH RUNNERS

(75) Inventor: Holger Wuerthner, Villingen-Schwenningen (DE)

(73) Assignee: Onyx-Systems Patentmanagement GmbH., Villingen-Schwenningen (DE)

( * ) Notice: Subject to any disclaimer, the term of this patent is extended or adjusted under 35 U.S.C. 154(b) by 0 days.

(21) Appl. No.: 14/237,632

(22) PCT Filed: Jul. 31, 2012

(86) PCT No.: PCT/DE2012/100229

§ 371 (c)(1), (2), (4) Date: Apr. 22, 2014

(87) PCT Pub. No.: WO2013/020551

PCT Pub. Date: Feb. 14, 2013

(65) Prior Publication Data

US 2014/0284890 A1 Sep. 25, 2014

(30) Foreign Application Priority Data

Aug. 9, 2011 (DE) ..... 10 2011 080 660

(51) Int. Cl.

| | |
|---|---|
| ***A63C 1/30*** | (2006.01) |
| ***A63C 1/04*** | (2006.01) |
| ***A63C 1/32*** | (2006.01) |

(52) U.S. Cl.

CPC . *A63C 1/04* (2013.01); *A63C 1/303* (2013.01); *A63C 1/32* (2013.01); *A63C 2203/42* (2013.01)

(58) Field of Classification Search

CPC ..... A63C 1/30; A63C 1/303; A63C 1/32; A63C 1/34; A63C 1/36

USPC ..... 280/11.12, 11.16, 11.18, 841, 825

See application file for complete search history.

(56) References Cited

U.S. PATENT DOCUMENTS

| | | | | |
|---|---|---|---|---|
| 2,150,964 | A * | 3/1939 | Dornseif | 280/11.18 |
| 5,332,242 | A * | 7/1994 | Cann et al. | 280/11.18 |
| 5,769,434 | A * | 6/1998 | Wurthner | 280/11.18 |
| 5,988,683 | A * | 11/1999 | Venier et al. | 280/841 |
| 7,758,053 | B2 * | 7/2010 | Wylie et al. | 280/11.12 |
| 2008/0150242 | A1 | 6/2008 | Wurthner | |

FOREIGN PATENT DOCUMENTS

| | | |
|---|---|---|
| DE | 10 2005 004 515 B3 | 6/2006 |
| EP | 0 663 843 B1 | 7/1996 |
| WO | WO 94/08668 | 4/1994 |

* cited by examiner

*Primary Examiner* — John Walters

(74) *Attorney, Agent, or Firm* — Muirhead and Saturnelli, LLC

(57) ABSTRACT

A sports device with runners, in particular an ice skate, includes an exchangeable adapter with which the composite sliding blade is equipped. The running sole has a profiled slide strip made of a resilient material and side faces are provided with a negative cutting angle. The adapter is connected releasably to the holder of the sports device. The contour profile, namely the curvature of the sliding face of the profiled slide strip, is defined by the geometry of the exchangeable adapter. The sliding blade is clipped onto the adapter using tongues provided on the free end of the sliding blade and the locking lugs or locking slits provided on the adapter. The sliding blade has a perforation, such that the lower part of the sliding blade can be torn off without tools when changing the sliding blade, and a new sliding blade can be clipped on.

17 Claims, 5 Drawing Sheets

D:D

SPORTS DEVICE WITH RUNNERS

TECHNICAL FIELD

This application relates to a sports device with runners, which is especially suitable for winter sports, in particular an ice-skate.

BACKGROUND OF THE INVENTION

Ice-skates of this type generally have a sliding blade which is connected to the shoe via a holder. A disadvantage with said conventional runner technology is that, in order to change the sliding blade profile, the sliding blades, which are generally composed of steel, have to be ground in a highly complex manner.

The runner technology which is known from EP 663 843 B1 and DE 10 2005 004 515 B3 and in which an interchangeable sliding blade, which is composed of plastic, is provided with a steel profiled sliding strip which is integrated therein, does not have this disadvantage per se. For perfect coordination of the sports device with runners to respective user conditions in terms of movement dynamics, this technology requires a multiplicity of different types of sliding blades which have to be produced in cost-intensive production processes and kept in stock. In addition, these sliding blades are in each case suitable only for ice-skates of a certain manufacturer.

A further disadvantage is that, in this technology, a special injection molding die is required for each shape of sliding blade. This results in high tool, production and user costs. In addition, extremely high plastics material and disposal costs arise, since sliding blades of this type have a large plastics mass.

Efficient and cost-effective mass production and favorable marketing of sports devices with runners designed in such a manner are therefore impossible. Not least, the production and selling of sports devices with runners of this type require a considerable outlay on logistics.

Accordingly, it would be desirable to provide a sports device with runners, in particular an ice-skate, which does not have these disadvantages. As well as the advantages in terms of movement dynamics being maintained, the intention is especially to reduce the diversity of types in order to drastically reduce the production and therefore the labor costs without losing quality.

SUMMARY OF THE INVENTION

According to the system described herein, a sports device with runners is provided in that a releasable adapter is connected to the holder, in that a sliding blade which is composed of flexible plastic and has a profiled strip composed of a flexible, springy material, preferably steel, is placeable on the adapter in such a manner that the contour of the profiled sliding strip is determined by the convex end surface of the adapter, which end surface is opposite the profiled sliding strip.

This solution merely requires adapters of different shapes to be produced and kept in stock, since the standard geometry of the profiled sliding strip is determined by the geometry of the exchangeable adapter. Consequently, only the adapter has to be changed in order to change the sliding and moving properties of a sports device with runners fitted in such a manner. Appropriate adaptation of the adapter to the particular sports device with runners, i.e. to ice-skates of different manufacturers, means that only the adapter in the region of the holder provided on the sports device with runners has to be adapted.

According further to the system described herein, it is proposed to insert a compensating strip composed of flexible material between the end surface of the adapter and the sliding blade. Production tolerances can be compensated for with said compensating strip. In addition, it has an impact-damping effect.

Furthermore, a fitting strip which is expediently composed of ductile thermoplastic material can be inserted between the holder and the adapter. Said fitting strip is heated before installation of the adapter has taken place, while said fitting strip hardens at room temperature only after insertion of the adapter. In addition to the function compensating for manufacturing tolerance, said contour fitting strip, the specifically influencable ductility of which guarantees a play-free adaptation of the adapter in the vertical, longitudinal and transverse directions to the respective outer contour of the holder, has a noise- and impact-damping effect.

The sliding blade which is composed of flexible plastic can be fitted in an extremely simple manner on the holder without using a tool, namely clipped onto said holder. Construction measures that serve for this purpose are discussed elsewhere herein.

In a similarly simple manner, the sliding blade designed according to the system described herein can be released from the holder without a tool if said sliding blade has, in the region between the tongues and the profiled sliding strip, a perforation which permits a separation of tongues and sliding strip by tearing.

The anchoring of the adapter in the holder of the sports device with runners is also of some importance.

For improvement of said anchoring, it is proposed to provide a segmented web at the connecting point for the holder on the adapter, said web engaging in a longitudinal slot of the holder, said longitudinal slot corresponding to said web. In addition to said web, it is also possible to provide strut and screw stabilizers which are likewise to be inserted into recesses of the adapter and, of which, at least one is screwable to the holder while the other is held in a form-fitting manner in a slot of the holder. In addition, the segmenting of the web centers the contour fitting strip on the adapter. An adapter fastening which can be subjected to a high load and is simple to handle is proposed.

Proposals for the design and choice of material of the adapter and of the sliding blade are described elsewhere herein.

The design, according to the system described herein, of the sliding blade and the connection thereof to the holder via an adapter results in an abundance of advantages in respect of production, stock keeping, sale and handling, which are listed in brief below and which result in a decisive reduction in costs.

1. Since the shape of the sliding blade, namely the sliding surface profile of the profiled sliding strip, is determined exclusively by the geometry of the adapter, standardized sliding blades and profiled sliding strips can be used.
2. The user can change the shape of the sliding blade by interchanging the adapter and can therefore adapt said shape to the circumstances.
3. The interchangeable adapter system permits the use of the sliding blade according to the invention in sports devices with runners, in particular ice-skates, of different manufacturers. The installation and the interchanging of the sliding blades and of the adapter can be carried out rapidly and without the aid of skilled labor because of the simple construction.

4. The use of standardized sliding blades results in a significant reduction in costs for production, stock keeping and selling of the product.
5. The sliding blade which is substantially composed of lightweight material and the profiled sliding strip of which is preferably composed of steel results in a substantial reduction in weight compared with conventional runner constructions.
6. The adapter which is anchored in the holder of the sports device with runners and is inserted deep into the sliding blade with the profiled sliding strip thereof results in extraordinarily high vertical rigidity of the runner designed according to the invention, which permits an improvement of the properties in terms of movement dynamics.
7. The installation and removal of the adapter and sliding blade can be carried out in a simple manner without skilled labor.

BRIEF DESCRIPTION OF THE DRAWINGS

Embodiments of the system described herein are explained in detail below with reference to the drawings.

In the drawings.

DETAILED DESCRIPTION OF VARIOUS EMBODIMENTS

Figure 1:
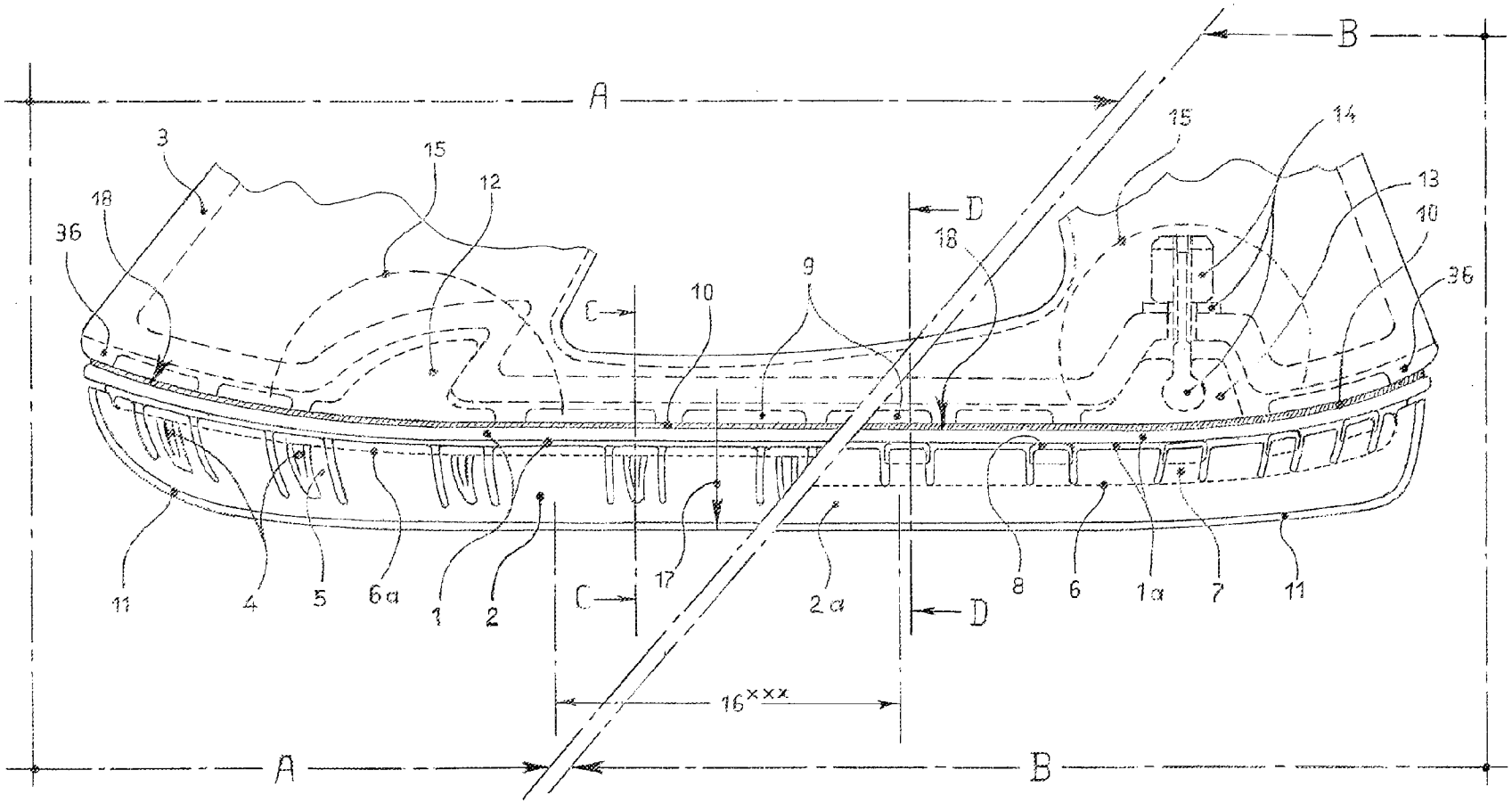
FIG. 1 shows a side view of an ice-skate/sliding-blade holder according to the system described herein, to which a sliding blade having a profiled sliding strip is attached via an adapter.

The basic construction of the sliding-blade and interchangeable adapter system according to the system described herein for an ice-skate is illustrated by FIG. 1.

Figure 4:
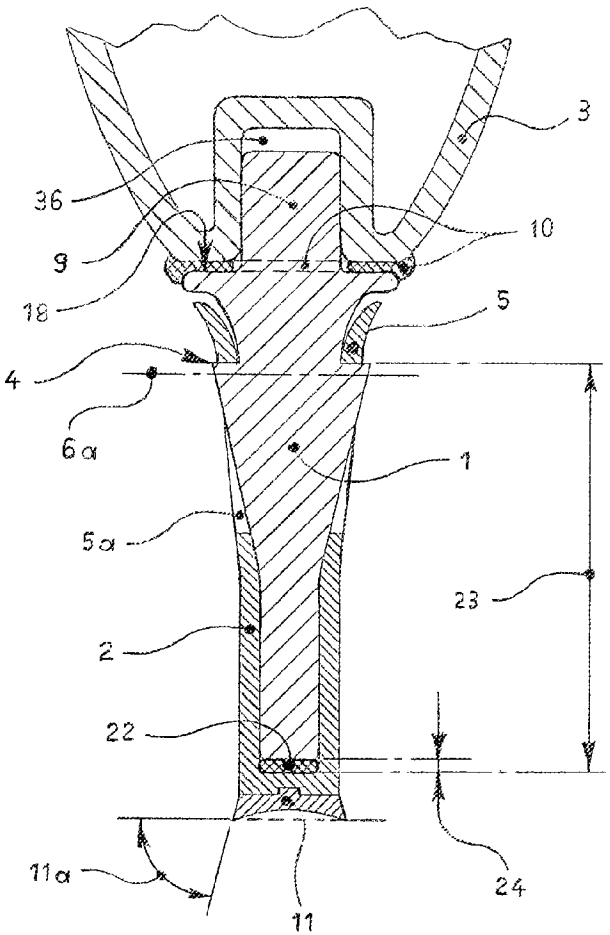
FIG. 4 shows a section along the line C-C in FIG. 1.
Figure 6:
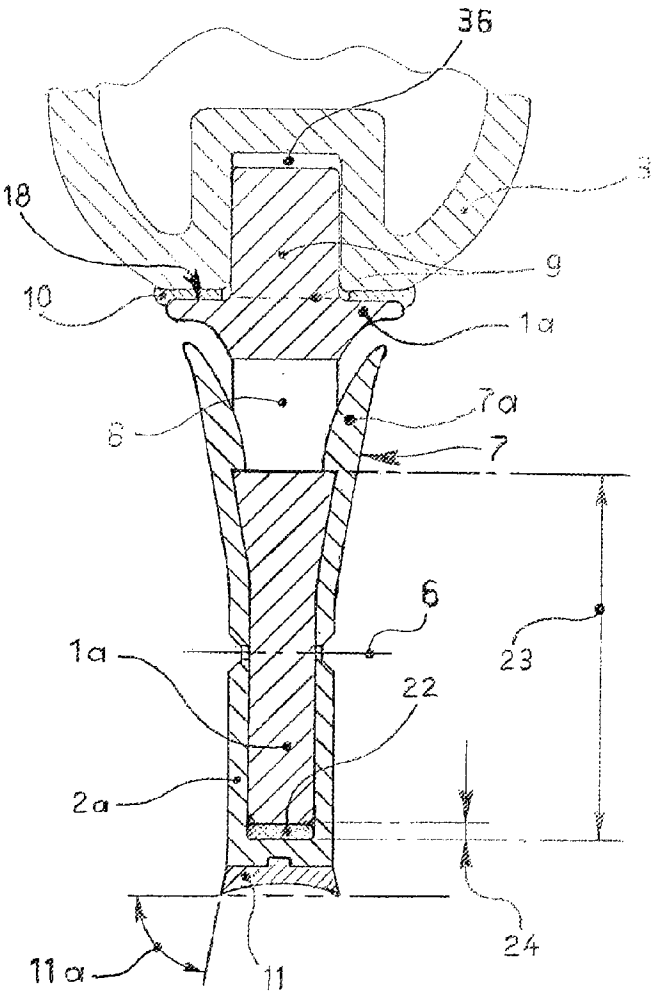
FIG. 6 shows a section along the line D-D in FIG. 1.

A holder 3, 3*a* is connected to the sole of an ice-skate (not illustrated), with a sliding blade 2, 2*a* being attached releasably to said holder via a releasable adapter 1, 1*a*, as is made clear by the sectional drawings according to FIGS. 4 and 6.

A flexible profiled sliding strip 11 which is composed of springy material, preferably spring steel, and which has an angle of intersection 11*a* of less than 90° is attached on the bottom end surface of the sliding blade 2, 2*a*, which is composed of plastic. The profiled sliding strip 11 can be adhesively bonded to the end surface of the sliding blade 2, 2*a* or partially insert molded with plastic during the production of the sliding blade. When the sliding blade 2, 2*a* is placed onto the adapter 1, 1*a*, the profiled sliding strip 11 is exactly adapted to the profile of the end surface of the adapter 1, 1*a*.

As FIG. 4 especially makes clear, the sliding blade 2 is clipped onto the adapter 1, which is of conical design in the upper region, wherein flexible perforated tongues 5 on both sides engage around the conical adapter region and are latched to the latter in the end position. For this purpose, the perforated tongues 5 are provided with elongated holes 5*a* into which the corresponding latching lugs 4 latch.

Figure 5:
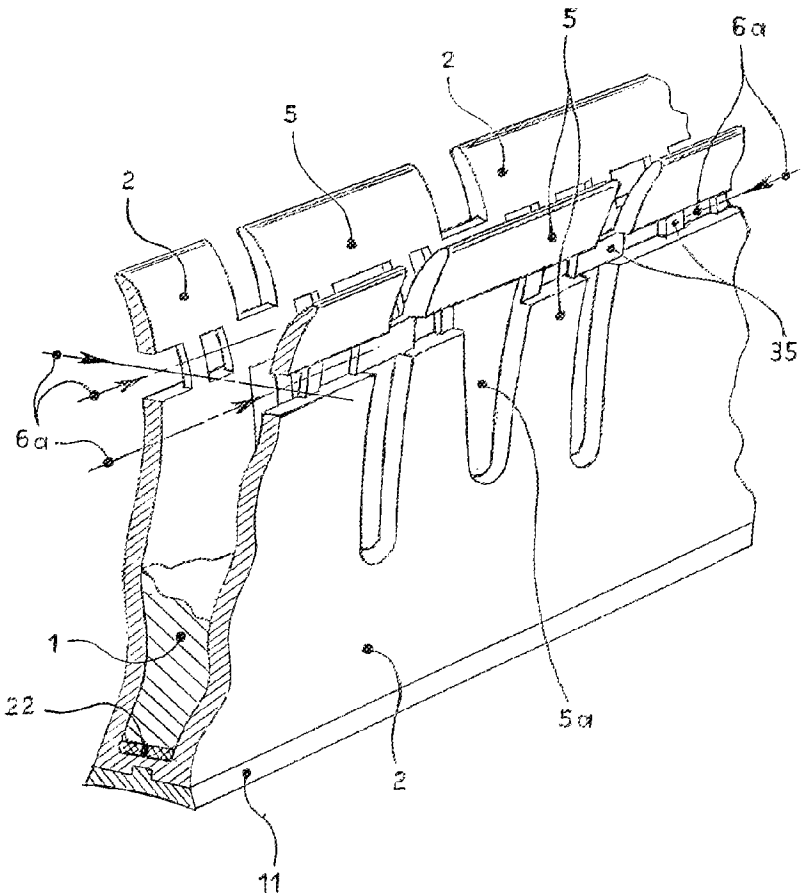
FIG. 5 shows a perspective partial illustration of the sliding blade according to FIG. 4.

As is illustrated by the section A in FIG. 1 and also FIG. 5, the perforated tongues 5 are distributed at uniform distances in a comb-like manner over the length of the sliding blade 2.

Figure 7:
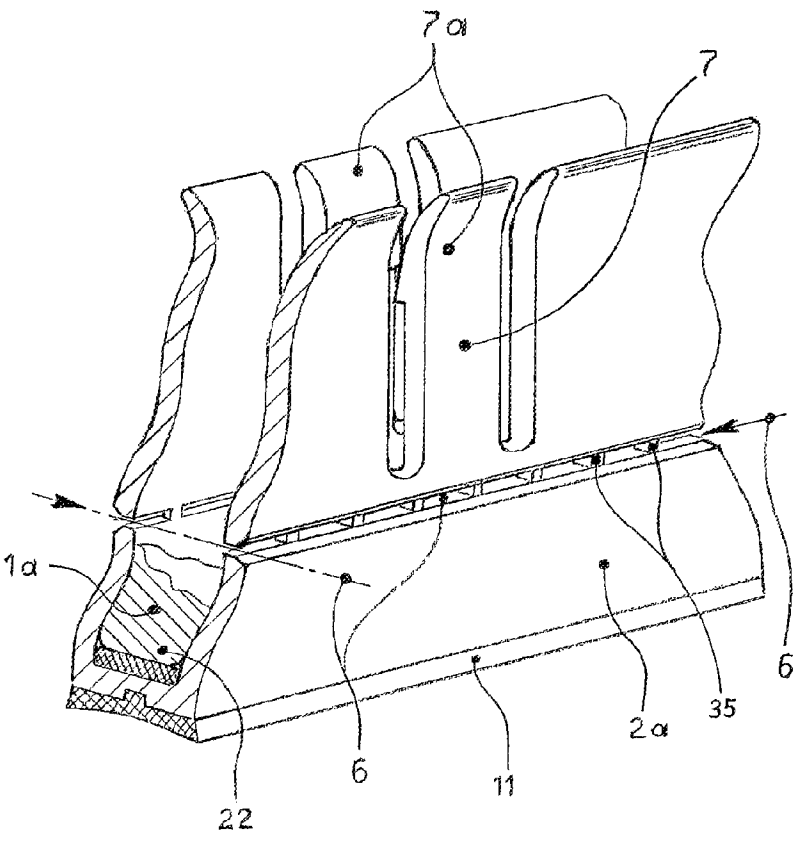
FIG. 7 shows a perspective partial illustration of the sliding blade according to FIG. 6.

A modified manner of fastening is illustrated in section B of FIG. 1 and by FIGS. 6 and 7. Instead of perforated tongues 5, lug-type tongues 7 are provided here, the lugs 7*a* of which, which are located at the free end, engage in the corresponding latching slots 8. The lug-type tongues 7 and the latching slots 8 are also distributed here at uniform distances in a comb-like manner over the length of the sliding blade 2*a*.

For the purpose of changing the sliding blade 2 or 2*a*, the perforated tongues 5 or the lug-type tongues 7 have to be deflected outward, in order then to pull the sliding blade 2 or 2*a* downward. Since a very strong connection between sliding blade 2, 2*a* and adapter 1, 1*a* is required because of the considerable loading during ice-skating, this is not easy to bring about. In order to permit a tool-free detaching of the sliding blade 2, 2*a*, a perforation 6, 6*a* is provided, said perforation permitting the sliding blade section having the profiled sliding strip 11 to be detached from the section having the perforated tongues 5 or lug-type tongues 7. For this purpose, the perforation webs 35 arranged on both sides of the longitudinally extending perforation line have to be separated, which is possible by tearing along the perforation line. In the modified design in the region A, the perforation 6*a* is located in the vicinity of the lower side of the holder 3. In the design in the region B, the perforation 6 is located in the vicinity of the profiled sliding strip 11.

The adapter 1 is anchored in a downwardly open slot 36 of the holder 3 by a web which is divided into segments 9. Furthermore, a strut stabilizer 12 and screw stabilizer 13 engage in the corresponding recesses of the holder 3, wherein the rear screw stabilizer 13 is fixed by a screw connection 14 whereas the front strut stabilizer 12 is held in a form-fitting manner by means of the inclination thereof.

A contour fitting strip 10 composed of a heat-reactionary material which is heated before the beginning of the fastening process is inserted between the holder 3 and the upper section of the adapter 1, 1*a*. During the course of the fastening process, the thermoplastic material of the contour fitting strip 10 that has been heated and become ductile is deformed until the adapter 1, 1*a* is firmly seated in the holder 3 and the contour fitting strip 10 has compensated for the differences in shape and dimensions between the adapter 1, 1*a* and holder 3 along the adapter contour line 18. After cooling, the contour fitting strip 10 loses its ductility and maintains its shape, which is adapted to the contour, until the contour fitting strip 10 is reheated. As a result, dimensional and contour differences are compensated for and a play-free axial and vertical connection between the adapter 1, 1*a* and the holder 3, 3*a* is guaranteed. The contour fitting strip 10 which is now frictionally connected assists and improves the play-free transmission of extremely high transverse forces between the holder 3, 3*a* and the adapter 1, 1*a*. In addition, the flexible contour fitting strip 10 acts as an impact damper.

Furthermore, a preferably adhesively bonded compensating strip 22 which is inserted between the lower end surface of the adapter 1, 1*a* and the sliding blade 2, 2*a* and is composed of ductile material acts in an impact-damping manner, said compensating strip serving, firstly, to absorb the latching-on pressure of the sliding blade 2, 2*a* and, secondly, serving with the thickness 24 thereof to compensate for tolerances, and therefore an exact height 23 is maintained over the length of the sliding blade.

Figure 2:
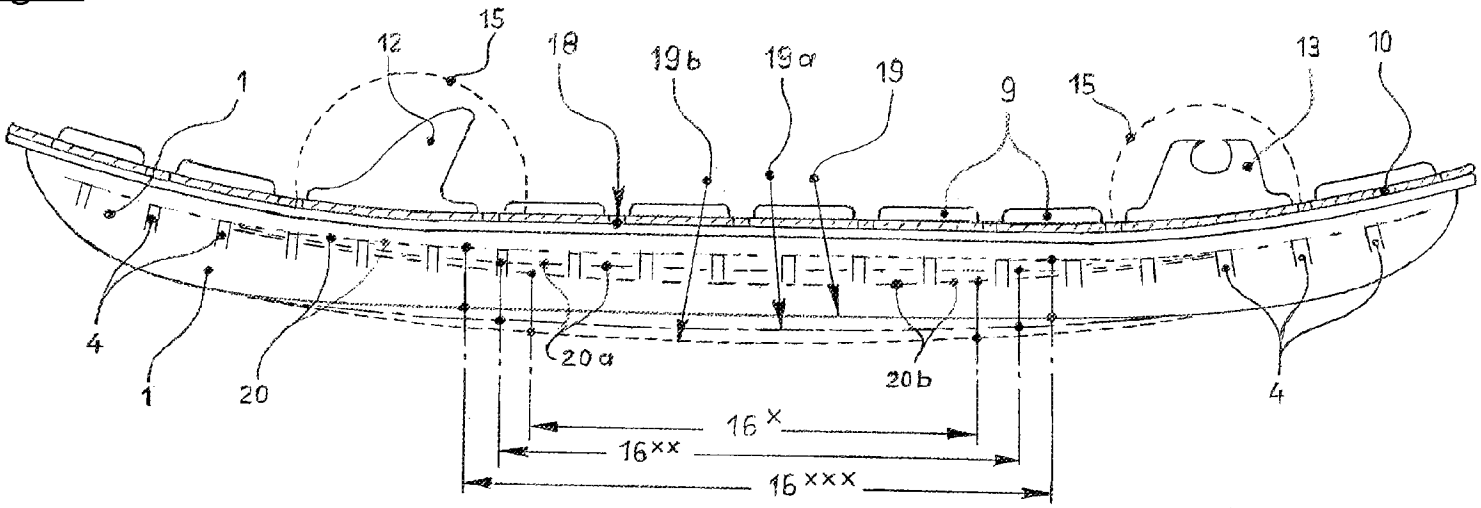
FIG. 2 shows a side view of an adapter according to a first exemplary embodiment.
Figure 3:
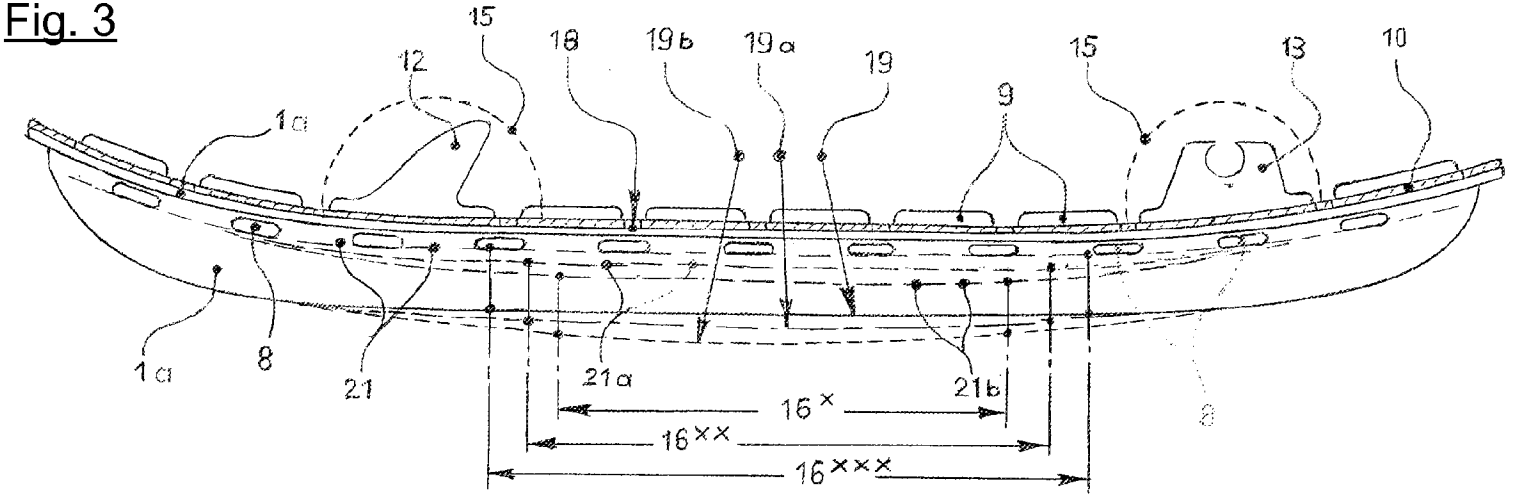
FIG. 3 shows a side view of an adapter according to a second exemplary embodiment.

Two different adapters 1 and 1*a* are illustrated by FIGS. 2 and 3.

The adapter 1 according to FIG. 2 is equipped on both sides with a series of narrow, comb-like latching lugs 4 which are distributed uniformly over the length of the adapter 1 along the line 20. Parallel to said line 20, the bottom end surface of the adapter 1 runs along the line 19, at least in the region of the sliding surface length 16xxx. The geometry of the adapter 1 therefore determines, by means of the lines 19 and 20 thereof, the profile and the length of the sliding surface 16xxx of the sliding blade 2 placed onto the adapter 1. In order to be able optimally to adapt the properties in terms of movement dynamics of the ice-skate runner to the respective use conditions, the size of the sliding surface of the profiled sliding strip 11 can be changed by interchanging the adapter 1. For this purpose, the adapter 1 can be interchanged for an adapter in which the latching lugs 4 run along the line 20*a* and therefore the profile of the end surface on the adapter 1 runs along the line 19*a*. The flexible sliding blade 2, which is placed onto said adapter, is adapted by means of its integrated profiled sliding strip 11 to said profile, as a result of which the length of the sliding surface is shortened to the region 16xx.

A further shortening to the region 16x is achieved by insertion of an adapter 1 with an arrangement of the latching lugs 4 along the line 20*b* and with a profile of the end surface of the adapter 1 along the line 19*b*, which has a smaller radius than the line 19 or 19*a*.

By means of these measures, use can be made of a standardized sliding blade 2 with an undefined radius 17, since the radius of the sliding blade 2 and of the profiled strip 11 connected thereto, and therefore the curved profile thereof, is determined by the geometry of the adapter 1 with the different radii thereof for the lines 19, 19*a* and 19*b*. Consequently, by interchanging the adapter 1, the user can coordinate the respectively desired sliding surface lengths 16 of type xxx, xx or x, and therefore the running properties of the runner, perfectly to the use conditions.

The same applies for the adapter 1*a* which has latching slots 8 and is illustrated in FIG. 3.

As indicated by dashed lines, the latching slots 8 can alternatively run along the curved lines 21, 21*a* and 21*b* and the end surfaces of the adapter can run along the curved lines 19, 19*a* and 19*b*, as a result of which, as already explained with reference to FIG. 2, sliding surfaces of differing length 16xxx, 16xx and 16x are produced.

Figure 9:
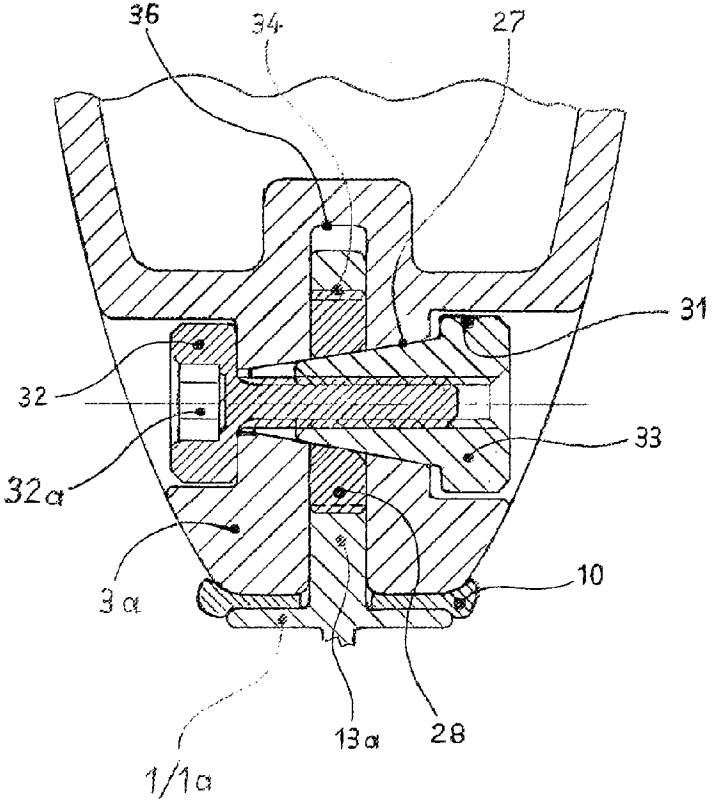
FIG. 9 shows a section along the line E-E in FIG. 8.
Figure 8:
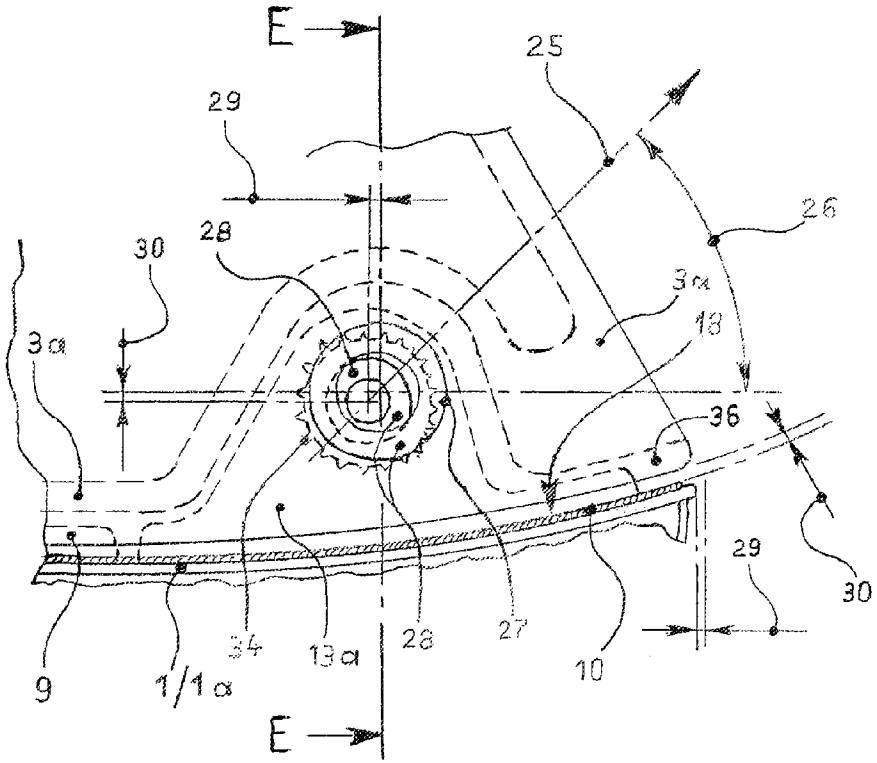
FIG. 8 shows a lateral partial view, partially in section, in the rear region of the adapter fastened to the ice-skate/sliding-blade holder.

The adapter 1, 1*a* is fastened to the holder 3 in the fastening sections 15 by means of the strut stabilizer 12 and the screw stabilizer 13. The front strut stabilizer 12, which is inclined to the rear, enters here into a recess, which corresponds thereto, of the holder 3, as illustrated in FIG. 1. The rear screw stabilizer 13 is drawn by means of a screw connection 14 into a recess of the holder 3, said recess likewise corresponding to said screw stabilizer, as a result of which the adapter 1 is connected fixedly to the holder 3. the fastening by means of the screw stabilizer 13*a*, which is illustrated in FIGS. 8 and 9, is fixable by an eccentric screw connection and is also described in detail below, is particularly efficient and can be subjected to a greater load.

Furthermore, in other holder or adapter designs, other fastening alternatives are possible, for example with transverse screw connections, as are required for ice-skates of other manufacturers. By contrast, the construction of the adapters 1, 1*a* is identical below the contour line 18 for all ice-skate products, and therefore the latter can be fitted with the same sliding blades 2, 2*a*.

A type of fastening for the adapter 1 and 1*a* in the rear region of the holder 3*a*, which type of fastening can be subjected to particularly high loading and at the same time is simple and rapid to fit, is illustrated with reference to the detailed illustrations according to FIGS. 8 and 9. The screw stabilizer 13*a* here enters a recess 36, which corresponds thereto, of the holder 3*a*. Alternatively, a correspondingly designed sliding blade can also be fastened without the interconnection of an adapter.

For the play-free fixing of the adapter 1 or 1*a* in the holder 3*a*, the screw stabilizer 13*a* has an internally toothed bore into which an exchangeable eccentric conical toothed ring 28 is inserted, the outside of which eccentric conical toothed ring has an annular toothing 34, the teeth of which engage in a precisely fitting manner in the toothing of the screw stabilizer 13*a*. The conical bore in the conical toothed ring 28 is eccentric with respect to the center of the conical bore 27 in the holder 3*a*. By offsetting the eccentric conical toothed ring 28 within the internal toothing of the screw stabilizer, the eccentric conical bore of the conical toothed ring 28 can be positioned with respect to the center of the conical bore 27 in such a manner that, when the adapter 1 or 1*a* is firmly screwed in the holder 3*a*, the latter is pulled obliquely upward in the direction of the pulling axis 25 while maintaining an angle 26 with respect to the horizontal. By means of the left- or right-rotating offset of the eccentric conical toothed ring 28 in the screw stabilizer 13*a*, the eccentric bore in the conical toothed ring 28 migrates in a crescent-shaped manner out of the center of the conical bore 27 in the holder 3*a* and, when the adapter 1 or 1*a* is tightly screwed, thereby influences the direction of the tensile forces and the pulling axis angle 26 resulting therefrom. In order to be able optimally to adapt the effective tensile force, the screw stabilizer 13*a* can optionally be equipped with eccentric toothed rings 28, the conical eccentric bores of which have a smaller or greater offset.

The adapter 1 or 1*a*, provided with the screw stabilizer 13*a*, is inserted into the holder 3*a*, provided with the conical bore 37. The screw stabilizer 13*a* is fitted with the eccentric conical toothed ring 28 in which an eccentric conical bore is located. The two conical bores are passed through by a conical nut 33 which is tightened by the transverse screw 32. The latter has a hexagon socket 32*a* for a suitable tool, while the conical nut 33 has a polygonal head 31 fixed in the recess of the holder 3*a*.

When the transverse screw 32 is tightened, the cone of the conical nut 33 pulls the adapter 1/1*a* in the direction of the pulling axis 25 with the aid of the eccentric conical toothed ring 28. Depending on the size of the eccentric in the eccentric conical toothed ring 28, the adapter 1/1*a* is pulled obliquely upward in the direction of the pulling axis via the displacement 29 in the direction of the longitudinal axis and the displacement 30 in the vertical direction until the cone in the eccentric conical toothed ring 28 is congruent with the conical bore 27. By means of the displacement 29 along the longitudinal axis, the adapter 1/1*a* here is pulled in the direction of the rear end of the holder 3*a*, as a result of which the front strut stabilizer 12, which is illustrated in FIGS. 1, 2 and 3, is optimally fixed in the holder 3*a*. The displacement 30 along the vertical axis has the effect that the holder 3*a* is pulled by the adapter contour line 18 counter to the holder 3*a* until the conical bore 27 is congruent with the eccentric conical toothed ring bore and can be fixed in a play-free manner in the end position thereof. During this operation, the previously heated contour fitting strip 10 is compressed in a precise manner in terms of contour between the adapter contour line 18 and the holder 3*a*, as a result of which contour differences which are present between the holder 3*a* and the adapter contour line 18 are compensated for.

The adapter proposed by the system described herein permits the use of identically designed sliding blades 2/2*a* for ice-skates of different manufacturers. The adapter 1, la which is composed of an injection moldable material, preferably magnesium, is constructed in such a manner that, despite extremely high loading, use can be made of an exchangeable sliding blade 2, 2*a* which is formed from plastic and springy material, preferably spring steel, in a composite construction. The running surface of the sliding blade 2, 2*a* is preferably provided with a profiled sliding strip 11 which has a negative angle of intersection 11*a* and is composed of wear-resistant, flexible steel. The properties in terms of movement dynamics of an ice-skate equipped in such a manner can be varied with profiled sliding strips of different sliding surface profiles.

The sliding blade is installed and removed in an extremely simple manner.

First of all, after the contour strip 10 is placed on, the adapter 1, 1*a* should be connected to the holder 3, 3*a* of the ice-skate (not illustrated), wherein the web segments 9 of the adapter 1, 1*a* are inserted into the adapter slot 36. The sliding blade 2, 2*a* is thereupon clipped onto the adapter 1, 1*a*, with perforated tongues 5 or lug-type tongues 7 latching into recesses corresponding thereto. The profiled sliding strip 11 located on the running side of the sliding blade 2, 2*a* is adapted here to the respective profile of the end surface 19, 19*a*, 19*b* of the selected adapter 1 or 1*a*, as a result of which sliding surface lengths of differing sizes 16xxx, 16xx and 16x are produced. The user therefore has the possibility, through selection of the available adapters 1/1*a*, of determining the movement properties of his ice-skates.

The tool-free removal of the sliding blade 2, 2*a* from the adapter 1, 1*a* is also extremely simple. For this purpose, the perforation webs 35 of the perforation 6 or 6*a* merely need to be destroyed mechanically, for example by tearing, with upper and lower parts of the sliding blade 2, 2*a* being able to be separated from each other and removed in a simple manner.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

LIST OF DESIGNATIONS

1, 1*a* Adapter
2, 2*a* Sliding blade
3, 3*a* Holder
4 Latching lugs
5 Perforated tongue
5*a* Elongated hole
6, 6*a* Perforation
7 Lug-type tongues
7*a* Lugs
8 Latching slots
9 Web segments
10 Contour fitting strip
11 Profiled sliding strip
11*a* Angle of intersection
12 Strut stabilizer
13, 13*a* Screw stabilizer
14 Screw
15 Fastening sections
16 Sliding surface length type xxx, xx, x
17 Sliding blade radius
18 Adapter contour line
19, 19*a*, 19*b* Adapter lines
20, 20*a*, 20*b* Latching lug lines
21, 12*a*, 21*b* Latching slot lines
22 Compensating strip
23 Height
24 Thickness
25 Pulling axis
26 Pulling axis angle
27 Conical bore
28 Eccentric conical toothed ring
29 Displacement along the longitudinal axis
30 Displacement along the vertical axis
31 Polygonal head
32 Transverse screw
32*a* Hexagon socket
33 Conical nut
34 Annular toothing
35 Perforation webs
36 Adapter slot

The invention claimed is:

1. An ice skate with runners, comprising:
a sliding blade;
a holder to which the sliding blade is attached;
a releasable adapter connected to the holder, wherein the sliding blade, which is composed of flexible plastic and has a profiled sliding strip composed of flexible material is placeable onto the adapter in such a manner that a running surface contour of the profiled sliding strip is determined by a convex end surface of the adapter, wherein an end surface of the adapter is opposite the profiled sliding strip.

2. The ice skate with runners as claimed in claim 1, further comprising:
a compensating strip composed of flexible material inserted between the end surface of the adapter and the sliding blade.

3. The ice skate with runners as claimed in claim 1, further comprising:
a fitting strip which is composed of ductile, thermoplastic material inserted between the holder and the adapter, said fitting strip being heated before installation of the adapter and, after insertion of the adapter, hardens at room temperature.

4. The ice skate with runners as claimed in claim 1, wherein the sliding blade has, on both sides of the adapter, flexible tongues which, after installation has taken place, engage in latches of the adapter.

5. The ice skate with runners as claimed in claim 4, wherein the tongues are arranged in a comb-like manner.

6. The ice skate with runners as claimed in claim 4, wherein the tongues have latching openings in which latching lugs provided on the adapter engage.

7. The ice skate with runners as claimed in claim 4, wherein the tongues have latching lugs which engage in latching slots or troughs provided on the adapter.

8. The ice skate with runners as claimed in claim 4, wherein, in the region between the tongues and the profile sliding strip, the sliding blade has a perforation permitting separation of tongues and sliding strip by tearing.

9. The ice skate with runners as claimed in claim 1, wherein the adapter has a segmented web which engages in a longitudinal slot of the holder, said longitudinal slot corresponding to said web.

10. The ice skate with runners as claimed in claim 1, wherein the adapter has strut and screw stabilizers which are inserted into recesses, corresponding thereto, of the holder.

11. The ice skate with runners as claimed in claim 10, wherein at least one of the screw stabilizers is screwable to the holder while at least one of the strut stabilizers is held in a form-fitting manner in the slot of the holder.

12. The ice skate with runners in particular as claimed in claim 10, wherein the sliding blade is connected to a holder using the strut and screw stabilizers, and wherein an eccentric screw connection using a conical nut and a screw passes transversely through the screw stabilizer and the holder.

13. The ice skate with runners as claimed in claim 12, wherein the screw and the conical nut pass through a toothed ring, an eccentric conical bore of which is eccentric with respect to a center of the conical bore of the holder.

14. The ice skate with runners as claimed in claim 13, wherein the conical toothed ring has an annular toothing corresponding to internal toothing of the screw stabilizer.

15. The ice skate with runners as claimed in claim 1, wherein profiled sliding strip of the sliding blade has side surfaces which have a negative angle of intersection which is smaller than 90 degrees with respect to the sliding surface.

16. The ice skate with runners as claimed in claim 1, wherein the adapter is composed of injection moldable material, wherein the sliding blade is composed of injection moldable material into which the profiled sliding strip, composed of springy material is embedded or adhesively bonded.

17. The ice skate with runners as claimed in claim 16, wherein the adapter is composed of magnesium, wherein the sliding blade is composed of plastic, and wherein the profiled sliding strip is made of spring steel.

* * * * *